US006105169A

United States Patent [19]

Colorado

[11] Patent Number: 6,105,169

[45] Date of Patent: Aug. 22, 2000

[54] EXTRICATION HARNESS APPARATUS

[76] Inventor: Juancarlos Colorado, P.O. Box 2111, Petaluma, Calif. 94953

[21] Appl. No.: 09/352,664

[22] Filed: Jul. 8, 1999

Related U.S. Application Data

[60] Provisional application No. 60/092,328, Jul. 8, 1998.

[51] Int. Cl.[7] ..... A41D 1/06; A47L 3/04

[52] U.S. Cl. ..... 2/81; 182/6

[58] Field of Search ..... 2/81, 79, 227; 182/6

[56] References Cited

U.S. PATENT DOCUMENTS

| | | | |
|---|---|---|---|
| 112,552 | 3/1871 | Conley . | |
| 416,550 | 12/1889 | Betten . | |
| 1,574,529 | 2/1926 | Abrahma . | |
| 2,647,293 | 8/1953 | Wintercorn | 2/81 |
| 2,979,153 | 4/1961 | Hoagland et al. . | |
| 3,176,793 | 4/1965 | Hlacia . | |
| 3,973,643 | 8/1976 | Hutchinson . | |
| 4,076,101 | 2/1978 | Himmelrich . | |
| 4,378,921 | 4/1983 | Allen et al. | 244/151 R |
| 4,645,033 | 2/1987 | Oselsclager . | |
| 5,036,548 | 8/1991 | Grilliot et al. . | |
| 5,136,724 | 8/1992 | Grilliot et al. | 2/81 |
| 5,145,027 | 9/1992 | Petzl et al. | 182/3 |

*Primary Examiner*—Bibhu Mohanty
*Attorney, Agent, or Firm*—Douglas E. White

[57] ABSTRACT

A harness strap assembly is incorporated into the inner liner of the pants of a firefighter's turnout suit. The harness strap assembly comprises a single length of webbed strap (or, preferably, a securely interconnected bifurcated length) that is wound forward around the user's waist through waist belt loops; then down through loops at the crotch of the pant liner; thence back around under the user's buttocks; then through loops on both thigh sides of the liner; and finally back forward to the fly area of the liner. Adjacent to the fly, the crotch portions of the strap pass through a pair of carabineer loops, which loops are not stitched or otherwise affixed to the liner. Instead, looped ends of the harness strap hold the two carabineer loops. The carabineer loops, in turn, are interlinked with a metal climber's carabineer of conventional design.

17 Claims, 6 Drawing Sheets

EXTRICATION HARNESS APPARATUS

CROSS REFERENCE TO RELATED APPLICATIONS

This application claims the benefit of U.S. Provisional Application No. 60/092,328 filed Jul. 8, 1998.

FEDERALLY SPONSORED RESEARCH OR DEVELOPMENT

Not applicable.

FIELD OF THE INVENTION

This invention relates to firefighters' turnout suits, more particularly, to turnout pants into which is integrated a self-adjusting climber's harness.

BACKGROUND OF THE INVENTION

Firefighters may become entrapped in the upper floors of a multistory building with no internal means of escape. Many tragically have become severely burned, or even killed, as a result. On such occasions, it is known to use a rope and an emergency climbing harness to rappel down to the ground, or at least to a lower floor which is not burning or is otherwise safe. However, such equipment is bulky and therefore not always brought by the firefighter into the building. Even when it is available, in an emergency situation it can be difficult and time consuming to put on, because the firefighter may be running low on oxygen, and smoke and the lack of electric light may be obscuring his or her vision.

Prior developments in this field may be generally illustrated by reference to the following information disclosure statement:

| U.S. Pat. Documents | | |
|---|---|---|
| U.S. Pat. No. | Patentee | Issue Date |
| 5,136,724 | W. Grilliot et al. | Aug. 11, 1992 |
| 5,036,548 | W. Grilliot et al. | Aug. 6, 1991 |
| 3,973,643 | J. Hutchinson | Aug. 10, 1976 |
| 2,979,153 | E. Hoagland et al. | Apr. 11, 1961 |
| 4,076,101 | L. Himmelrich | Feb. 28, 1978 |
| 1,574,529 | S. Abrahma | Feb. 23, 1926 |
| 4,645,033 | H. Oselsclager | Feb. 24, 1987 |
| 3,176,793 | R. Hlacia | Apr. 6, 1965 |
| 112,552 | J. Conley | Mar. 14, 1871 |
| 416,550 | J. Betten | Dec. 3, 1889 |

U.S. Pat. Nos. 5,036,548 and 5,136,724 teach forms of combined firefighters' turnout pants and safety harness.

U.S. Pat. No. 3,973,643 teaches a firefighters' safety coat with detachable harness.

U.S. Pat. No. 2,979,153 teaches a safety suit with built-in harness.

There continues to be a need for a new and improved extrication harness apparatus, which addresses the problems of construction, effectiveness and ease of use that are attendant in the prior art. In this respect, the present invention substantially fulfills this need.

SUMMARY OF THE INVENTION

In view of the disadvantages inherent in the known art, the general purpose of the present invention, which will be described subsequently in greater detail, is to teach a new and improved extrication harness apparatus which has all of the important advantages of the prior art and few, if any, of the disadvantages.

Firefighters wear a special turnout suit, the turnout pants of which comprise a fireproof outer shell and a separate thermal-barrier liner. The present invention is a harness strap assembly (hereinafter the "harness strap"), similar in function to a climbing harness, that is incorporated into the liner of the pants of a turnout suit. The suit liner, which in the prior art typically has no belt loops, is modified by the addition of two or more (preferably up to about ten) belt loops. The loops may incorporate snaps or hook and loop fastener patches for inserting and releasing the harness strap itself, but these loops preferably will be sewn or riveted shut (the harness strap being threadable through them).

It is to be noted in this regard that the belt loops do not ever bear the weight of the firefighter, but merely are for positioning the harness around the waist, thighs and crotch of the user during normal wearing of the turnout suit—prior to the need for emergency use.

The harness strap assembly comprises a single length of webbed strap (or, preferably, a securely interconnected bifurcated length) that is wound forward around the user's waist through the waist belt loops; then down through loops at the crotch of the liner; thence back around under the user's buttocks; then through loops on both thigh sides of the pant liner; and finally back forward to the fly area of the liner. Adjacent to the fly, on their way down through the crotch, the crotch portions of the strap pass through a pair of carabineer loops, which loops are not stitched or otherwise affixed to the liner. Instead, the two looped ends of the harness strap hold the two carabineer loops. The carabineer loops, in turn, may be interlinked with a metal climber's carabineer of conventional design.

A pair of belt members may be affixed to the waist portion of the harness strap and fastened together into a belt that may be used for cinching the harness strap up at the liner pant waist. The belt is supplied chiefly to keep the apparatus comfortably in place during normal wear. The belt performs the secondary function of keeping the turnout pants up without the need for suspenders. However, at no time during emergency use do the belt members have to support any of the user's weight. Therefore, they can be made of lightweight, non load-bearing material, and any buckle or other belt fastener means used to keep them together does not have to meet load-bearing safety standards.

There preferably is a load-bearing safety-grade adjustment buckle on the waist portion of a bifurcated harness strap, or other means for adjusting the overall length of the harness strap relative to the girth of the wearer. This typically only needs to be done once, during the very first fitting thereof. It never has to be done during an emergency, or even during normal firefighting operations. In some embodiments of this invention, the belt and the adjustment buckle functions (above) can in effect be combined in a single clasp, such as a double D-ring clasp at the front of the device.

To escape out of a window in a burning building, one need only secure a rope to a suitable fixed structure. Next, the climbing rope is wound through the carabineer (or carabineers) in the normal fashion. The firefighter immediately may rappel down to safety.

There is no need to put the harness on during the time of the emergency, because one automatically encases one's waist and legs in the harness when the turnout pants are put on.

Importantly, as noted above, there is also no need to adjust or tighten the harness during the emergency—when the firefighter may have only precious moments to exit the building. The use of a single (or interconnected bifurcated) harness strap threaded loosely through strategically placed loops on the pant liner allows the harness to be self-adjusting. Unlike known emergency harnesses, the present harness apparatus automatically tightens up upon receiving the user's weight.

The harness adds little weight to the turnout pants, and, during normal wear, the crotch portions of the harness strap hang loose, so as not to be confining or uncomfortable. Therefore, there is great incentive, and little disincentive, for a firefighter to adopt the modified turnout pants of this invention.

FEATURES AND ADVANTAGES

It is therefore an object of the present invention to provide a new and improved extrication harness apparatus which has all, or nearly all, of the advantages of the prior art, while simultaneously overcoming most of the disadvantages normally associated therewith.

It is another object of the present invention to provide a new and improved extrication harness apparatus which may be easily and efficiently manufactured and marketed.

It is a further object of the present invention to provide a new and improved extrication harness apparatus which is of a rugged, durable and reliable construction and which meets or exceeds known safety standards and codes.

An even further object of the present invention is to provide a new and improved extrication harness apparatus which is susceptible of a low cost of manufacture with regard to both materials and labor, and which accordingly is then susceptible of low prices of sale to firefighters and fire departments, thereby making such a extrication harness apparatus economically available to the buying public.

Still another object of the present invention is to provide extrication harness apparatus wherein the same permits an increased ease of assembly relative to the art.

Another feature is a new and improved extrication harness apparatus that is lightweight, easy to use, unobstructive, unobtrusive in appearance and suitable for mass production.

Accordingly, a feature of this invention is an extrication harness apparatus, including: a turnout pants liner; a plurality of belt loops affixed to said liner; and a strap assembly having a first looped end, a first thigh portion, a first crotch portion, at least one waist portion, a second crotch portion, a second thigh portion, and a second looped end, said first looped end leading to said first thigh portion, said first thigh portion leading to said first crotch portion, said first crotch portion leading to said at least one waist portion, said at least one waist portion leading to said second crotch portion, said second crotch portion leading to said second thigh portion, said second thigh portion leading to said second looped end, one of said crotch portions passing through one of said looped ends, the other of said crotch portions passing through the other of said looped ends, said strap assembly attached to said turnout pants liner by said plurality of belt loops.

Another feature is such a device further including: a waist of said turnout pants liner; at least one waist belt loop affixed to said waist of said turnout pants liner, said at least one waist portion passing through said at least one waist belt loop; a crotch of said turnout pants liner; and first and second crotch belt loops affixed to said crotch of said turnout pants liner, said first crotch portion passing through said first crotch belt loop and said second crotch portion passing through said second crotch belt loop.

Yet another feature is such an apparatus further including: a carabineer; a first carabineer loop of said first looped end, said first crotch portion passing through said first carabineer loop, said carabineer attached to said first carabineer loop; and a second carabineer loop of said second looped end, said second crotch portion passing through said second carabineer loop, said carabineer attached to said second carabineer loop.

Still other features are first and second outer pants thighs of said turnout pants liner; a first thigh belt loop attached to said first outer pants thigh, said first thigh portion passing through said first thigh belt loop; and a second thigh belt loop attached to said second outer pants thigh, said second thigh portion passing through said second thigh belt loop.

Yet other features are first and second free ends of said strap assembly, said free ends bifurcating said strap assembly at said least one waist belt portion, said free ends attached adjustably together by a knot or buckle.

Another feature or object is to disclose such an apparatus further including: a first belt member attached to said at least one waist portion adjacent said first free end; a second belt member attached to said at least one waist portion adjacent said second free end; and a clasp attached to at least one of said first and second belt members.

Still other features include a first free end of said strap assembly and a second free end of said strap assembly, wherein said at least one waist portion is bifurcated into a first waist portion and a second waist portion, said first waist portion leading to said first free end, and said second waist portion leading to said second free end.

Another embodiment includes first and second front belt loops affixed to said waist of said turnout pants liner, wherein said first crotch portion, said first looped end, and said second waist portion pass through said first front belt loop, and wherein said second crotch portion, said second looped end, and said first waist portion pass through said second front belt loop.

In yet another embodiment there are first upper and first lower bights on said first front belt loop, and second upper and second lower bights on said second front belt loop, wherein said first crotch portion and said first looped end pass through said first lower bight, wherein said second waist portion passes through said first upper bight, wherein said second crotch portion and said second looped end pass through said second lower bight, and wherein said first waist portion passes through said second upper bight.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWING

The invention will be better understood and objects other than those set forth above will become apparent when consideration is given to the following detailed description thereof. Such description makes reference to the annexed drawing wherein.

Figure 1:
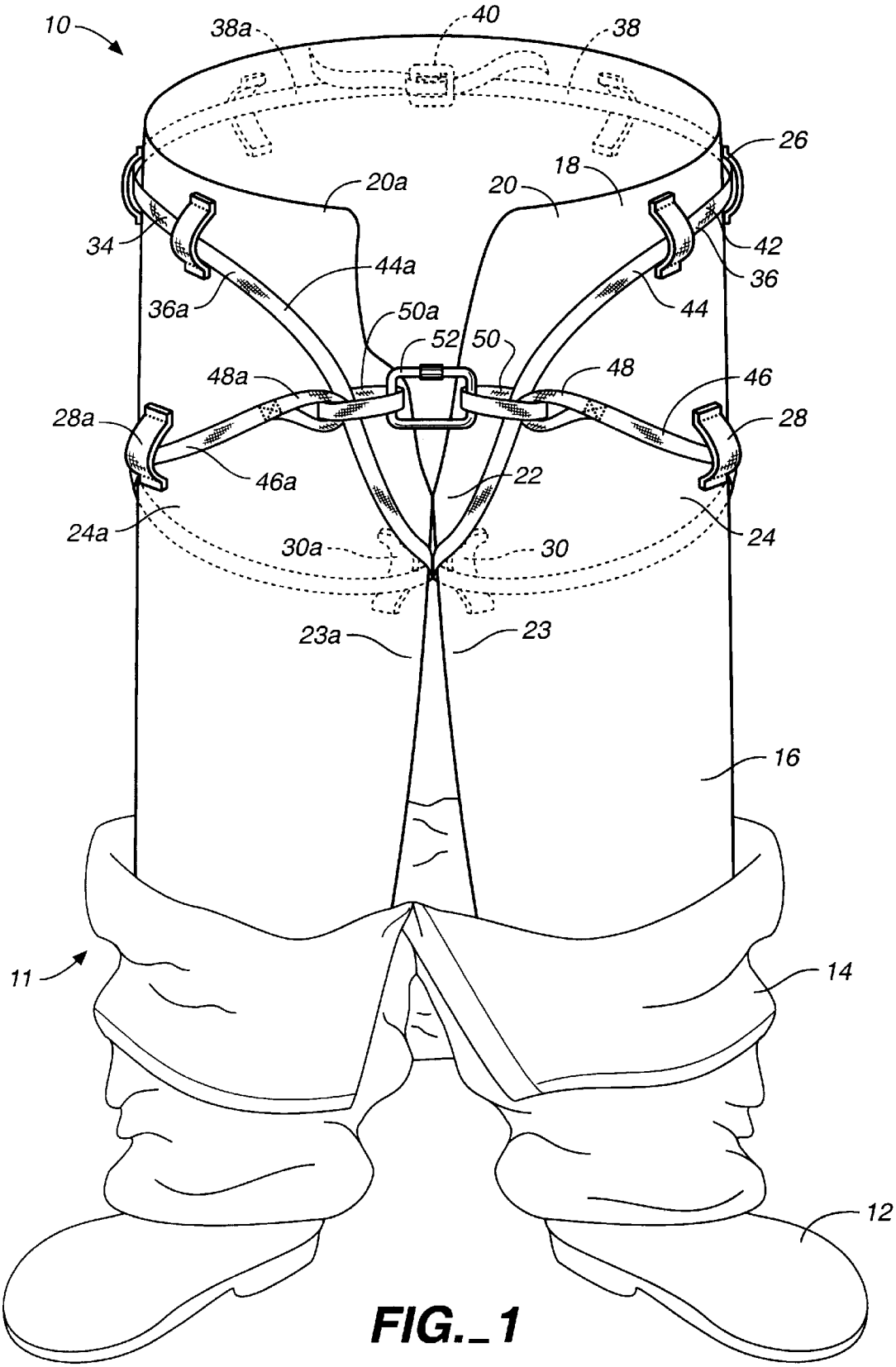
FIG. 1 is a front elevation of a first preferred embodiment of the harness apparatus of this invention, showing the harness strap thereof in an open or first position.

DRAWING REFERENCE NUMERALS 10 extrication harness apparatus
11 turnout pants
12 boot
14 shell
16 liner
18 waist
20 first fly panel
20a second fly panel
22 crotch
23 first inner pant thigh
23a second inner pant thigh
24 first outer pant thigh
24a second outer pant thigh
26 waist belt loop
28 first thigh belt loop
28a second thigh belt loop
30 first crotch belt loop
30a second crotch belt loop
34 harness strap assembly
36 first strap member
36a second strap member
38 first free end
38a second free end
40 adjustment buckle
42 waist portion
44 first crotch portion
44a second crotch portion
46 first thigh portion
46a second thigh portion
48 first looped end
48a second looped end
50 first carabineer loop
50a second carabineer loop
52 carabineer
134 harness strap assembly
138 first free end
138a second free end
140 knot
234 harness strap assembly
242 waist portion
252 carabineer
260 first belt member
260a second belt member
262 double D-ring clasp
264 belt
265 stitches
310 extrication harness apparatus
316 liner
318 waist
322 crotch
326 first front waist belt loop
326a second front waist belt loop
326b rear waist belt loop
327 snap
330 first crotch belt loop
330a second crotch belt loop
334 harness strap assembly
336 first strap member
336a second strap member
338 first free end
338a second free end
342 first waist portion
342a second waist portion
344 first crotch portion
344a second crotch portion
346 first thigh portion
346a second thigh portion
348 first looped end
348a second looped end
350 first carabineer loop
350a second carabineer loop
352 carabineer
362 double D-ring clasp
410 extrication harness apparatus
416 liner
426 first front waist belt loop
426a second front waist belt loop -continued

| |
|---|
| 426b rear waist belt loop |
| 430 first crotch belt loop |
| 430a second crotch belt loop |
| 434 harness strap |
| 436 first strap member |
| 436a second strap member |
| 438 first free end |
| 438a second free end |
| 442 first waist portion |
| 442a second waist portion |
| 444 first crotch portion |
| 444a second crotch portion |
| 446 first thigh portion |
| 446a second thigh portion |
| 448 first looped end |
| 448a second looped end |
| 450 first carabineer loop |
| 450a second carabineer loop |
| 462 double D-ring clasp |
| 470 first upper bight |
| 470a second upper bight |
| 472 first lower bight |
| 472a second lower bight |

It is to be noted that, for convenience, the last two positions of the reference numerals of alternative embodiments of the invention duplicate those of the numerals of the embodiment of FIG. 1, where reference is made to similar or corresponding parts. However, it should not be concluded merely from this numbering convention that similarly numbered parts are equivalents.

DETAILED DESCRIPTION OF THE INVENTION

Figure 2:
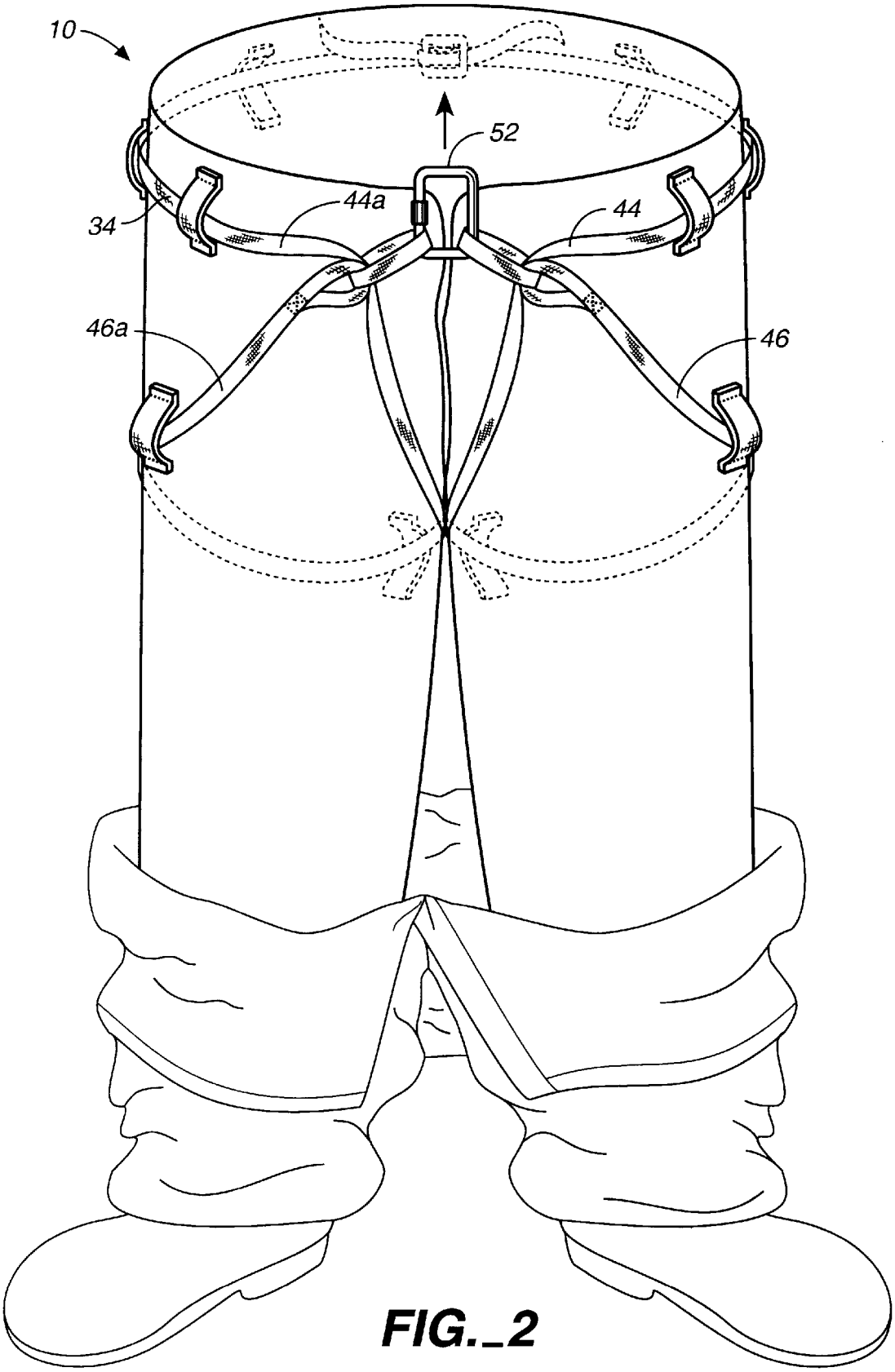
FIG. 2 is a front elevation of the embodiment of FIG. 1, showing the harness strap in a closed or second position.
Figure 2A:
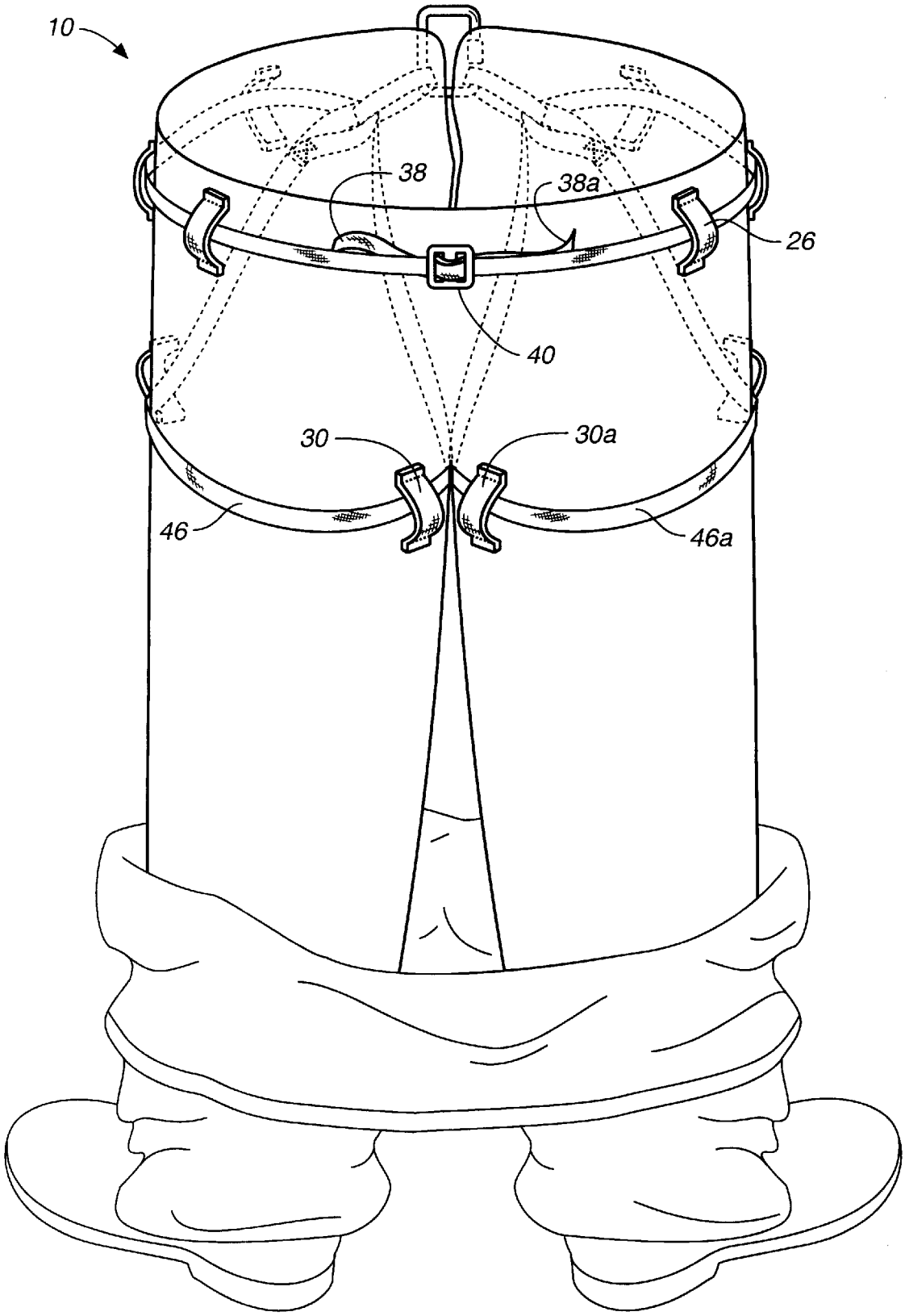
FIG. 2A is a rear elevation of the embodiment of FIG. 1 with the harness strap in the second position.

Referring to FIGS. 1, 2 and 2A, there is illustrated therein an extrication harness apparatus 10 of this invention. The harness strap assembly 34 of the harness apparatus 10 is shown in FIG. 1 in an open or first position. FIG. 2 shows the harness strap 34 thereof in a closed or second position. FIG. 2A is a rear elevation of the extrication harness apparatus 10, with the harness strap 34 in the second position.

The extrication harness apparatus 10 comprises modified turnout pants 11, whose principal parts are a fireproof outer shell 14, a thermal-barrier insulating fabric liner 16 encased in the shell 14, and a harness strap 34 loosely threaded though a series of belt loops that are sewn, riveted or otherwise affixed to the liner 16.

The pant liner 16 is bounded along its upper edge by its waist area 18, which waist is split in front by a first fly panel 20 and a mating second fly panel 20*a*. Below the fly area is a crotch 22, defined by the juncture of the fly panels, a first inner pant thigh area 23, and a second inner pant thigh area 23*a*. Opposite the inner thighs 23, 23*a* are the first outer pant thigh area 24 and the second outer pant thigh area 24*a*. Of course, this trouser-like structure of the liner 16 is common in the art.

However, belt loops typically are absent in prior art turnout suit pant liners, because the liners are held onto their shells by hook and loop fasteners, snaps or the like and the shells are held up by suspenders. The liner 16 of this invention has a regularly spaced series of belt loops attached to it by stitches, snaps, rivets or the like. Because these loops bear none of the user's weight, each may have one end releasably secured by a zipper, snap, hook and loop fastener, or the like, in order more readily to accept the installation of the harness strap 34 discussed below.

The waist 18 of the liner 16 holds perhaps two to six waist belt loops 26 symmetrically spaced at regular intervals. The first outer pant thigh 24 and second outer pant thigh 24*a* hold first thigh belt loop 28 and second thigh belt loop 28*a*, respectively. On opposite sides of the rear of the crotch 22 are affixed first crotch belt loop 30 and second crotch belt loop 30*a*.

The harness strap 34 may be made of one continuous piece of strong, flexible webbed or woven cloth material. However, in such a configuration, different size harness straps 34 would have to be provided to accommodate the wide variety of body shapes and sizes of firefighters. Preferably then, the harness strap 34 is bifurcated, but remains a unitary assembly, namely, it is comprised of a first strap member 36 and a second strap member 36*a*. These strap members 36, 36*a* are at all times securely held together at their free ends 38, 38*a*, respectively, by harness strap length adjusting means, such as a safety-tested, rescue-standard adjustment buckle 40.

A waist portion or portions 42 of the harness strap 34 is formed adjacent to the mating of the free ends 38, 38*a*, or forms the mid-portion of a continuous-web harness strap (not illustrated). The waist portion leads into a first crotch portion 44 and a second crotch portion 44*a*. The crotch portions of the harness strap 34 lead, in turn, to a first thigh portion 46 and a second thigh portion 46*a*. The latter portions terminate in a first looped end 48 and a second looped end 48*a*, respectively. Permanently sewn into the looped ends 48, 48*a* of the harness strap 34 are a pair of circular strap loops, namely, the first carabineer loop 50 and the second carabineer loop 50*a*. These latter loops are not affixed to the pant liner 16. Releasably affixed to the carabineer loops 50, 50*a* is a standard metal climber's carabineer 52 of conventional design. The carabineer 52 interlocks the carabineer loops 50, 50*a*, and, through them, the looped ends 48, 48*a*—causing the harness strap 34 itself to form a single loop overall, which is intertwined with the new belt loops of the pant liner 16 in the following manner.

Beginning at the adjustment buckle 40 at the rear of the extrication harness apparatus 10, the waist portion 42 of the harness strap 34 is threaded through from two up to about six waist belt loops 26 of the liner 16. In front of the extrication harness apparatus 10, the first crotch portion 44 and second crotch portion 44*a* dip down and back through the crotch 22 where they pass through the first crotch belt loop 30 and second crotch belt loop 30*a*, respectively. Thereafter, the first thigh portion 46 and the second thigh portion 46*a* pass around under the user's buttock area (FIG. 2A) and back forward through the first thigh belt loop 28 and second thigh belt loop 28*a*, respectively. The thigh portions 46, 46*a* return to the front of the extrication harness apparatus 10 in the vicinity of the first fly panel 20 and the second fly panel 20*a*, where their looped ends 48, 48*a* hold the two carabineer loops 50, 50*a*. Through the carabineer loops also pass the first crotch portion 44 and second crotch portion 44*a* of the first strap member 36 and second strap member 36*a*, respectively.

Figure 3:
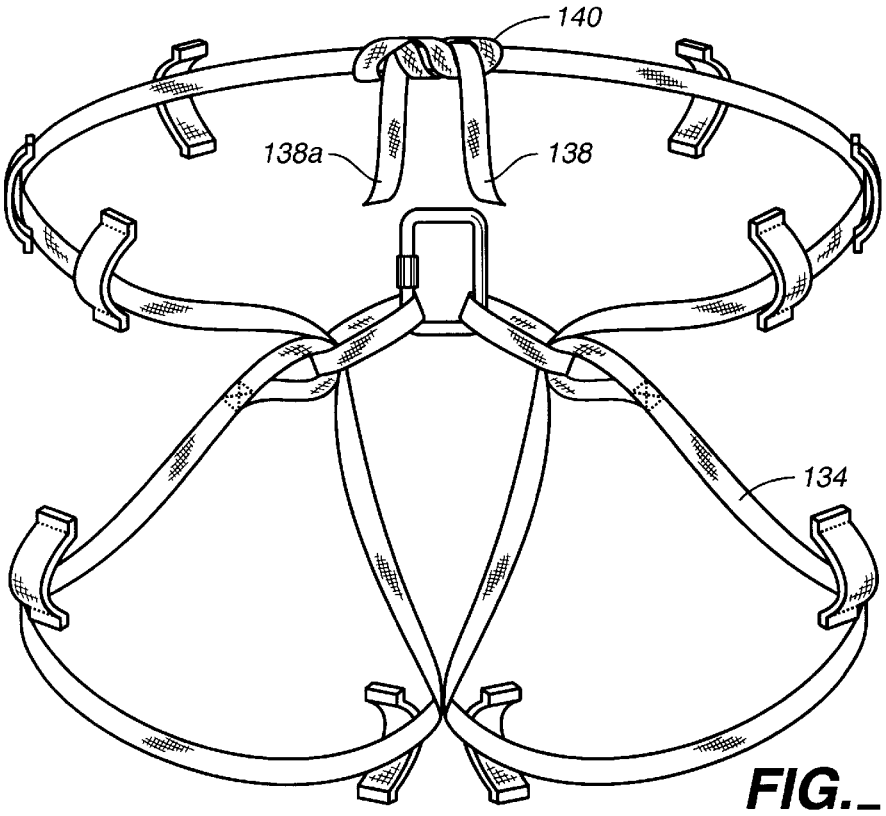
FIG. 3 is a front elevation of a second embodiment of this invention, showing a modified second harness strap for use with the turnout pants of the embodiment of FIG. 1 (said turnout pants being broken away for clarity of illustration)

FIG. 3 illustrates a second embodiment of this invention, namely, one having a modified harness strap 134 for use with the turnout pants 11 of the embodiment of FIG. 1 (said turnout pants being broken entirely away in FIG. 3 for clarity of illustration). The sole modification of this embodiment is that the adjustment buckle 40 has been replaced with a simple knot 140 holding together the first free end 138 and the second free end 138*a*. Preferably, knot 140 is what is known as a "water" knot, which type of knot has been specifically approved for emergency situations faced by firefighters. Knot 140, then, is one of a number of alternative types of approved means for adjusting the length of the harness strap 134, which means could also comprise any of a number of suitable alternative clasps, buckles and knots.

Figure 4:
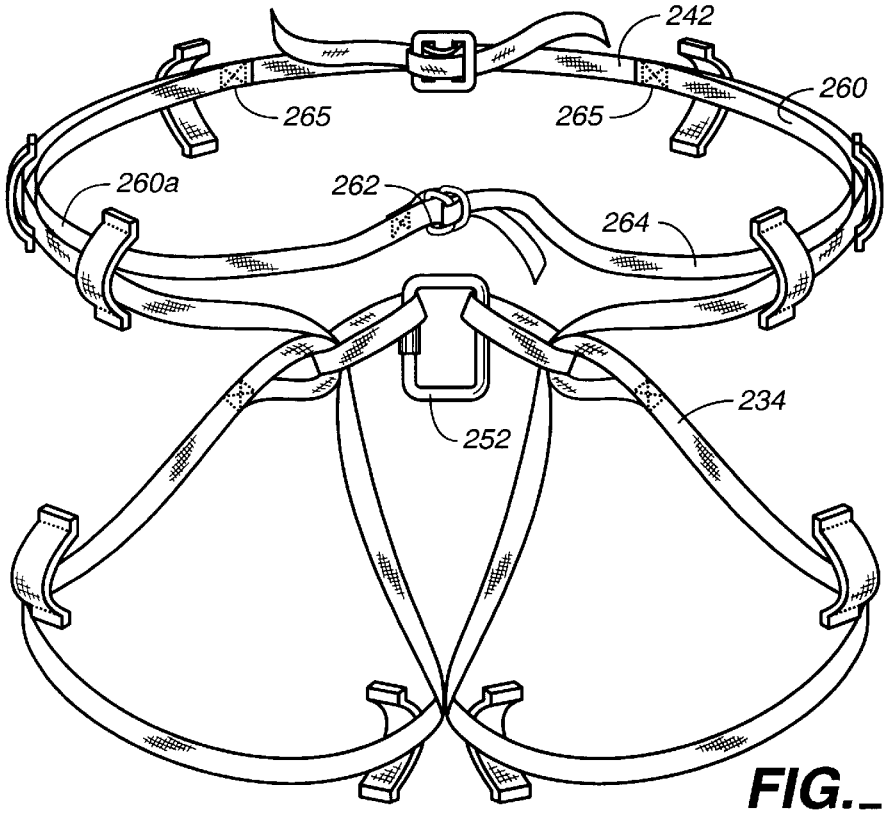
FIG. 4 is a front elevation of a third embodiment of this invention, showing a modified third harness strap for use with the turnout pants of the embodiment of FIG. 1 (said turnout pants being broken away for clarity of illustration)

FIG. 4 shows yet another modified harness strap 234 for use with the turnout pants 11 of the embodiment of FIG. 1 (said turnout pants being broken entirely away in FIG. 4 for clarity of illustration). Sewn by stitches 265 (or riveted, or otherwise affixed) to opposite inner sides of the waist portion 242 of the harness strap 234 are a pair of short straps, namely, a first belt member 260 and a second belt member 260*a*. These straps may be fastened together by any suitable belt fastener means, such as double D-rings 262 (or water knot, buckle, or the like). Together, they form a belt 264 that may be used to hold the turnout pants 11 (not illustrated) up around the user's waist when suspenders become uncomfortable or are disconnected. The belt 264 may also be desired by some users to adjust the harness strap 234 into a more comfortable position during normal firefighting operations. However, the belt 264 loosens automatically with respect to the user's waist when a rope draws the carabineer 252 into the closed position shown in FIG. 4. Therefore, the belt 264 and its belt fastener means 262 never bear the weight of the user during an emergency rappel. They need not meet stringent safety standards, and may be made of relatively flimsier material.

Figure 5:
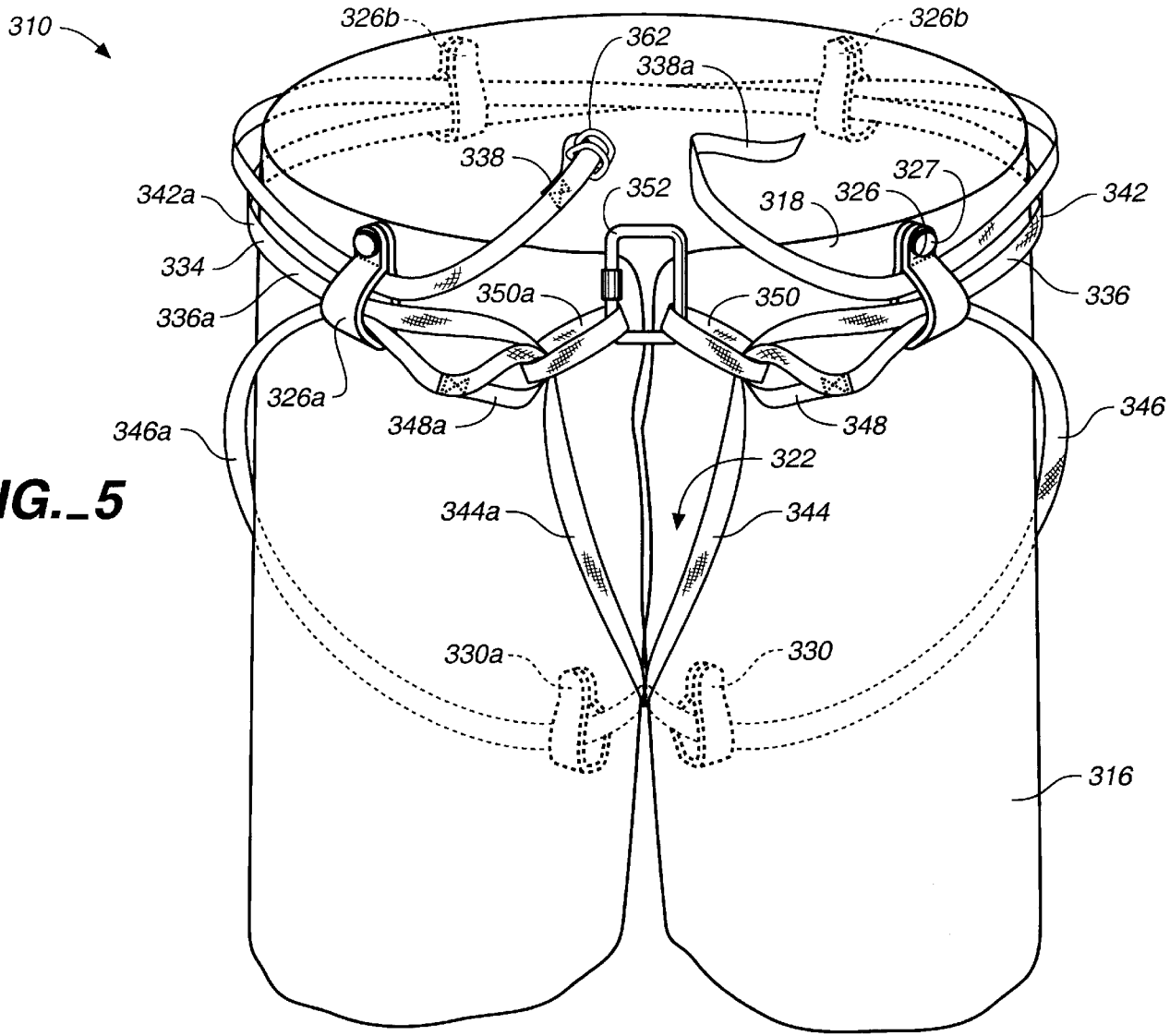
FIG. 5 is a front elevation of a fourth embodiment of this invention, showing a pair of strap members which cross over in back.

FIG. 5 illustrates a fourth embodiment of this invention, namely, extrication harness apparatus 310. Apparatus 310 is chiefly comprised of a harness strap assembly 334 having two interconnected strap members, namely, first strap member 336 and second strap member 336*a*. This embodiment also comprises turnout pant liner 316 and a series of guiding loops, as well as a double D-ring clasp 362 and a carabineer 352.

The first strap member 336 has a first looped end 348 which, as before, is attached to a first carabineer loop 350 holding the carabineer 352. The first looped end 348 passes through a first front waist belt loop 326. The first front waist belt loop 326 is attached to the waist 318 of the liner 316 by a snap 327 or similar means. Thereafter, the first thigh portion 346 of the first strap member 336 passes down from the waist 318, back around the user's thigh and buttock area and leads into or forms a first crotch portion 344 which passes through a first crotch belt loop 330 attached to the rear of the crotch 322 of the liner 316.

From that point, the first crotch portion 344 of the first strap member 336 passes through the first carabineer loop 350 and back through the first front waist belt loop 326 a second time. The first waist portion 342 encircles the waist 318, passing through one or more (preferably two) rear waist belt loops 326*b* and a second front waist belt loop 326*a*, whereupon the first strap member 336 terminates at the first free end 338. The first free end 338 has a double D-ring clasp 362 or another suitable type of clasp or the like.

The second strap member 336*a* has a second looped end 348*a* which, as before, is attached to a second carabineer loop 350*a* holding the carabineer 352. The second looped end 348*a* passes through the second front waist belt loop 326*a*. Thereafter, the second thigh portion 346*a* of the second strap member 336*a* passes down from the liner waist 318, back around the user's thigh and buttock area and forms a second crotch portion 344*a* which passes through a second crotch belt loop 330*a* attached to the rear of the crotch 322 of the liner 316.

From that point, the second crotch portion 344*a* of the second strap member 336*a* passes through the second carabineer loop 350*a* and back through the second front waist belt loop 326*a* a second time. The second waist portion 342*a* encircles the waist 318 and crosses over the first waist portion 342 of the first strap member 336 at the back of the waist 318. The second waist portion 342*a* passes through the one or more rear waist belt loops 326*b* and the front waist belt loop 326, whereupon the second strap member 336*a* terminates at the second free end 338*a*. The second free end 338*a* attaches to the double D-ring clasp 362 of the first free end 338. Alternatively, a water knot may be formed here.

When comparing the fourth embodiment of FIG. 5 with the previous embodiments, it can be seen, first of all, that the first front waist belt loop 326 and second front waist belt loop 326*a* perform extra duty. Three passes of strap material are made through each one, allowing the front thigh belt loops to be eliminated.

Secondly, by crossing the second strap member 336*a* over the first strap member 336 (or vice versa) at the back of the liner waist 318 and bringing the first and second free ends 338, 338*a* in front of the waist near the fly, the rear length-adjustment buckle is eliminated. One will recall that such a buckle usually is adjusted only once, preferably the first time a user put the turnout pants on, because it is in an out of reach area. With the embodiment of FIG. 5, the length of the crossover harness strap assembly 334 may be adjusted to the user's comfort each time the apparatus is worn. It still might be adjusted once and left in place, but this is not as likely. The crossover harness strap assembly 334 thus combines the supplementary belt features of the device of FIG. 4 with the length adjustment features of the devices of FIGS. 1–4.

Finally, when the free ends 338 and 338*a* are affixed together, as is the normal case, it can be seen that the first and second waist portions 342, 342*a* of the embodiment of FIG. 5 together can be said to form a single bifurcated waist portion like that of the previous embodiments—albeit one which is wrapped around the waist 318 two times.

Figure 6:
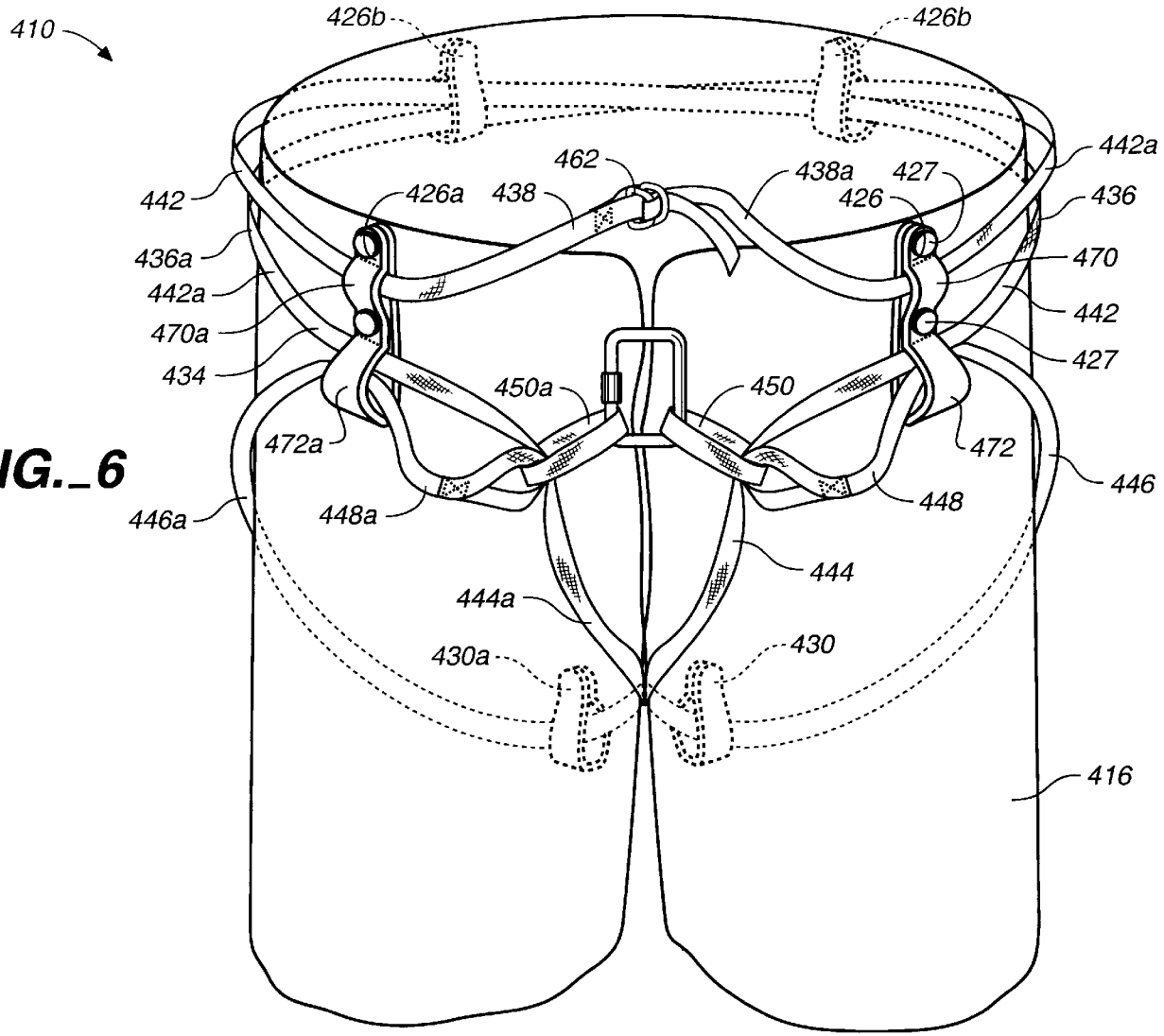
FIG. 6 is a front elevation of a fifth embodiment of this invention, showing a pair of cross-over strap members used in conjunction with double-bighted front loops.

FIG. 6 illustrates a fifth embodiment of this invention, namely, extrication harness apparatus 410. Apparatus 410 is chiefly comprised of a crossover harness strap assembly 434 having two interconnected strap members, namely, first strap member 436 and second strap member 436*a*.

The first strap member 436 has a first looped end 448 which, as before, is attached to a carabineer loop 450 and carabineer. The first looped end 448 passes through a first front waist belt loop 426 of modified design. The first front waist belt loop 426 is attached to the waist of the liner 416 by a pair of snaps 427 or similar means. These pair of snaps form a pair of bights, namely, first upper bight 470 and first lower bight 472. The first looped end 448 is threaded through the first lower bight 472. Thereafter, the first thigh portion 446 of the first strap member 436 passes down from the liner waist, back around the user's thigh and buttock area and leads to the first crotch portion 444 which passes through a first crotch belt loop 430.

From that point, the first crotch portion 444 of the first strap member 436 passes through the first carabineer loop 450 and back through the first lower bight 472 of the first front waist belt loop 426 a second time. The first waist portion 442 encircles the liner waist, passing through a plurality of rear waist belt loops 426*b* and a second upper bight 470*a* of a modified second front waist belt loop 426*a*, whereupon the first strap member 436 terminates at a double D-ring clasp 462 of the first free end 438.

The second strap member 436*a* has a second looped end 448*a* which is attached to a second carabineer loop 450*a*.

The second looped end 448*a* passes through a second lower bight 472*a* of the second front waist belt loop 426*a*. Thereafter, the second thigh portion 446*a* of the second strap member 436*a* passes down from the liner waist, back around the user's thigh and buttock area and leads to the second crotch portion 444*a* which passes through a second crotch belt loop 430*a* attached to the rear of the crotch.

From that point, the second crotch portion 444*a* of the second strap member 436*a* passes through the second carabineer loop 450*a* and back through the second lower bight 472*a* of the second front waist belt loop 426 a second time. The second waist portion 442*a* encircles the waist and crosses over the first waist portion 442 of the first strap member 436 at the back. The second waist portion 442*a* passes through the rear waist belt loops 426*b* and the first upper bight 470 of the modified front waist belt loop 426, whereupon the second strap member 436*a* terminates at the second free end 438*a*.

When comparing the fifth embodiment of FIG. 6 with the fourth embodiment of FIG. 5, it can be seen that the double-bighted front waist belt loops 426 and 426*a* also allow for the elimination of thigh belt loops, but in a manner that holds the thigh portions 446, 446*a* of the strap members 436, 436*a* down lower from the liner waist. This may be a more comfortable position for some users. Alternatively, it could be said that first lower bight 472 and second lower bight 472*a* are themselves thigh belt loops—note that the waist portions 442, 442*a* could be threaded through the first upper bight 470 and second upper bight 470*a* instead of the lower bights as shown, in which case the looping arrangement would be very similar to that of, for example, FIG. 4.

OPERATION

Referring for convenience to the embodiment of the invention illustrated in FIGS. 1, 2 and 2A, namely, extrication harness apparatus 10, use of the apparatus to extricate a firefighter or other safety worker from a hazardous emergency situation will be discussed.

After donning the apparatus 10 and adjusting the length of the harness strap 34 once by means of the adjustment buckle 40 or other length adjusting means, the apparatus is doffed and set aside. Typically, prior to use the extrication harness apparatus 10 already will have the firefighter's boots 12 in place in the pant legs of the shell 14 and liner 16 so that all three may be donned simultaneously. Probably, the shell 14 and liner 16 will be lifted up together, but for illustration in FIG. 1 the shell is down, showing the harness strap 34 in a first open position, namely, with the carabineer 52 hanging loose and low at the bottom of the fly, which position it will naturally assume and retain due to gravity. With the shell 14 up, the harness strap 34 will be so loose in the first position as not to be noticed by the firefighter during normal operations.

Upon occurrence of an emergency, such as the rapid spread of fire on the floor in which he or she is working, the firefighter may simply take a rope (not illustrated) which has been brought along for such purposes, and tie one end thereof onto a stable fixed portion of the building, such as a pipe, beam or the like, according to rescue systems approved by the State Fire Marshal, OSHA, or the like. Next, the other end is threaded through the carabineer 52, and coiled thereon the standard number of times. The firefighter exits the building through a window (or off the roof), whereupon he or she may rappel in the standard manner down to the ground, or down to a non-burning floor in the case of a highrise building (i.e., one higher than three floors).

FIG. 2 shows the closed or second position which the harness strap 34 automatically assumes when the carabineer 52 is jerked up by force of the climbing rope thereon. This action pulls the first thigh portion 46 and second thigh portion 46*a* inward and up, as well as the first crotch portion 44 and second crotch portion 44*a*. Such action significantly shortens the effective length of the harness strap 34, tightening it securely and safely around the user's waist, buttocks and thighs, which parts of the body then support the firefighter's weight. No action is required on the user's part to accomplish this tightening, other than applying force to the part of the rope wound around the carabineer 52.

Therefore, the extrication harness apparatus 10 is comfortable to wear, even unnoticeable, when not needed, but automatically and immediately becomes safely secured in its proper place through self-adjustment when used.

As to other manners of usage and operation of the instant invention, the same should be apparent from the above disclosure, and accordingly no further discussion relative to the manner of usage and operation of the instant invention need be provided.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For example, the number of waist loops, crotch loops, thigh loops and the like can be increased or decreased, as desired for safety or comfort. Additionally, the width of such loops could be increased, perhaps to the extent that such loops become strap-encapsulating tubes. With such equivalent modification, adjacent loops could be merged—for example, a single tube-like "loop" could encircle nearly all of the waist of the liner, replacing all other waist loops. As another example, the thigh and crotch loops on one side of the liner could be merged into a single tube or loop. Problems in threading the strap apparatus through such a tube could be alleviated by having one longitudinal seam thereof sealed by hook and loop fastener so that it could be broken open to insert a strap.

Another equivalent means of construction would be to eliminate the carabineer loops. Instead, the loops on the looped strap ends could be used both to hold the carabineer and to pass the crotch portions. Accordingly, "looped end" as used herein can include both a single loop on an end of a strap or a loop holding a loop.

The preferred strap or belt material is nylon webbing (preferably tubular). However, KEVLAR brand material, or a combination of natural and polymer materials could be substituted therefor.

Therefore, the above description and illustrations should not be construed as limiting the scope of the invention, which is defined by the appended claims.

The invention claimed is:

1. Extrication harness apparatus, including:

a turnout pants liner;

a plurality of belt loops affixed to said liner; and a strap assembly having
a first looped end,
a first thigh portion,
a first crotch portion,
at least one waist portion,
a second crotch portion,
a second thigh portion, and
a second looped end,
said first looped end leading to said first thigh portion, said first thigh portion leading to said first crotch portion, said first crotch portion leading to said at least one waist portion, said at least one waist portion leading to said second crotch portion, said second crotch portion leading to said second thigh portion, said second thigh portion leading to said second looped end, one of said crotch portions passing through one of said looped ends, the other of said crotch portions passing through the other of said looped ends, said strap assembly attached to said turnout pants liner by said plurality of belt loops.

2. The apparatus of claim 1 further including:

a waist of said turnout pants liner;

at least one waist belt loop affixed to said waist of said turnout pants liner, said at least one waist portion passing through said at least one waist belt loop;

a crotch of said turnout pants liner; and first and second crotch belt loops affixed to said crotch of said turnout pants liner, said first crotch portion passing through said first crotch belt loop and said second crotch portion passing through said second crotch belt loop.

3. The apparatus of claim 2 further including:

a carabineer;

a first carabineer loop of said first looped end, said first crotch portion passing through said first carabineer loop, said carabineer attached to said first carabineer loop; and a second carabineer loop of said second looped end, said second crotch portion passing through said second carabineer loop, said carabineer attached to said second carabineer loop.

4. The apparatus of claim 2 further including:

first and second outer pants thighs of said turnout pants liner;

a first thigh belt loop attached to said first outer pants thigh, said first thigh portion passing through said first thigh belt loop; and a second thigh belt loop attached to said second outer pants thigh, said second thigh portion passing through said second thigh belt loop.

5. The apparatus of claim 4 further including:

first and second free ends of said strap assembly, said free ends bifurcating said strap assembly at said least one waist belt portion, said free ends attached adjustably together by a knot or buckle.

6. The apparatus of claim 5 further including:

a first belt member attached to said at least one waist portion adjacent said first free end;

a second belt member attached to said at least one waist portion adjacent said second free end; and a clasp attached to at least one of said first and second belt members.

7. The apparatus of claim 2 further including:

a first free end of said strap assembly; and a second free end of said strap assembly,
wherein said at least one waist portion is bifurcated into a first waist portion and a second waist portion, said first waist portion leading to said first free end, and said second waist portion leading to said second free end.

8. The apparatus of claim 7 further including:

first and second front belt loops affixed to said waist of said turnout pants liner,
wherein said first crotch portion, said first looped end, and said second waist portion pass through said first front belt loop, and
wherein said second crotch portion, said second looped end, and said first waist portion pass through said second front belt loop.

9. The apparatus of claim 8 further including:

first upper and first lower bights on said first front belt loop; and second upper and second lower bights on said second front belt loop,
wherein said first crotch portion and said first looped end pass through said first lower bight,
wherein said second waist portion passes through said first upper bight,
wherein said second crotch portion and said second looped end pass through said second lower bight, and
wherein said first waist portion passes through said second upper bight.

10. Extrication harness apparatus, including:

a strap assembly;

a first looped end of said strap assembly;

a first thigh portion of said strap assembly;

a first crotch portion of said strap assembly;

at least one waist portion of said strap assembly;

a second crotch portion of said strap assembly;

a second thigh portion of said strap assembly;

a second looped end of said strap assembly,
said first looped end leading to said first thigh portion, said first thigh portion leading to said first crotch portion, said first crotch portion leading to said at least one waist portion, said at least one waist portion leading to said second crotch portion, said second crotch portion leading to said second thigh portion, said second thigh portion leading to said second looped end, one of said crotch portions passing through one of said looped ends, the other of said crotch portions passing through the other of said looped ends;

a turnout pants liner;

a waist of said turnout pants liner;

first and second outer pants thighs of said turnout pants liner;

a first thigh belt loop attached to said first outer pants thigh, said first thigh portion passing through said first thigh belt loop;

a second thigh belt loop attached to said second outer pants thigh, said second thigh portion passing through said second thigh belt loop; and at least one waist belt loop affixed to said waist, said at least one waist portion passing through said at least one waist belt loop.

11. The apparatus of claim 10 further including:

a crotch of said turnout pants liner; and first and second crotch belt loops affixed to said crotch of said turnout pants liner, said first crotch portion passing through said first crotch belt loop and said second crotch portion passing through said second crotch belt loop.

12. The apparatus of claim 11 further including:

a carabineer;

a first carabineer loop of said first looped end, said first crotch portion passing through said first carabineer loop, said carabineer attached to said first carabineer loop; and a second carabineer loop of said second looped end, said second crotch portion passing through said second carabineer loop, said carabineer attached to said second carabineer loop.

13. The apparatus of claim 12 further including:

first and second free ends of said strap assembly, said free ends bifurcating said strap assembly at said least one waist belt portion, said free ends attached adjustably together by a buckle.

14. The apparatus of claim 13 further including:

a first belt member attached to said at least one waist portion adjacent said first free end;

a second belt member attached to said at least one waist portion adjacent said second free end; and a double D-ring clasp attached to one of said first and second belt members.

15. The apparatus of claim 10 further including:

a first free end of said strap assembly; and a second free end of said strap assembly, wherein said at least one waist portion is bifurcated into a first waist portion and a second waist portion, said first waist portion leading to said first free end, and said second waist portion leading to said second free end.

16. Extrication harness apparatus, including:

a strap assembly;

a first looped end of said strap assembly;

a first thigh portion of said strap assembly;

a first crotch portion of said strap assembly;

first and second waist portions of said strap assembly;

a second crotch portion of said strap assembly;

a second thigh portion of said strap assembly;

a second looped end of said strap assembly, said first looped end leading to said first thigh portion, said first thigh portion leading to said first crotch portion, said first crotch portion leading to said first waist portion, said first waist portion interconnectable with said second waist portion, said second waist portion leading to said second crotch portion, said second crotch portion leading to said second thigh portion, said second thigh portion leading to said second looped end, said first crotch portion passing through said first looped end, said second crotch portion passing through said second looped end;

a turnout pants liner having a waist; and first and second front belt loops affixed to said waist of said turnout pants liner, wherein said first crotch portion, said first looped end, and said second waist portion pass through said first front belt loop, and wherein said second crotch portion, said second looped end, and said first waist portion pass through said second front belt loop.

17. The apparatus of claim 16 further including:

first upper and first lower bights on said first front belt loop; and second upper and second lower bights on said second front belt loop, wherein said first crotch portion and said first looped end pass through said first lower bight, wherein said second waist portion passes through said first upper bight, wherein said second crotch portion and said second looped end pass through said second lower bight, and wherein said first waist portion passes through said second upper bight.

* * * * *